United States Patent [19]

Nakagawa

[11] Patent Number: 4,760,723

[45] Date of Patent: Aug. 2, 1988

[54] ELONGATION CONTROL SYSTEM

[75] Inventor: Yoshiaki Nakagawa, Hyogo, Japan

[73] Assignee: Mitsubishi Denki Kabushiki Kaisha, Japan

[21] Appl. No.: 883,045

[22] Filed: Jul. 8, 1986

[30] Foreign Application Priority Data

Jul. 9, 1985 [JP] Japan ..... 60-151893

[51] Int. Cl.[4] ..... B21B 37/12

[52] U.S. Cl. ..... 72/8; 72/11; 72/17; 72/19; 72/20; 72/205; 364/472

[58] Field of Search ..... 72/8–12, 72/16, 17, 20, 243, 245, 205, 19; 364/472

[56] References Cited

U.S. PATENT DOCUMENTS

| | | | |
|---|---|---|---|
| 3,183,693 | 5/1965 | Sims | 72/19 |
| 3,319,444 | 5/1967 | Masterson, Jr. | 72/245 X |
| 3,820,365 | 6/1974 | Silva | 72/17 X |
| 4,244,025 | 1/1981 | Alshuk | 72/8 X |
| 4,292,825 | 10/1981 | Morooka et al. | 72/16 X |
| 4,428,054 | 1/1984 | Aizawa et al. | 72/8 X |

OTHER PUBLICATIONS

Handbook of Steel, 3rd Edition, May 15, 1980, pp. 674–677, Japanese with Translation.

*Primary Examiner*—Robert L. Spruill
*Assistant Examiner*—Steven B. Katz
*Attorney, Agent, or Firm*—Bernard, Rothwell & Brown

[57] ABSTRACT

An elongation control system for controlling the elongation of a work to be rolled by a rolling mill applied to a continuous thin plate rolling equipment, through control of the rolling load of a press down device in the mill and control of tension on the work, i.e., control of the rates of feed of the work by feeders. The press-down device for pressing down a work roll is controlled based on the difference between the actual elongation detected by an elongation detector and a preset reference elongation. The rolling load at the moment the actual elongation accords with the reference elongation is held by a rolling load holding circuit, and the difference between the actual press-down position of the press down device corresponding to that press-down load and a target press-down position is outputted as rate correction signal to feed rate controllers for controlling the feed rates on the basis of the respective tensions on the work on the entrance side and the exit side of the rolling mill, whereby the feed rates are controlled and, therefore, the tensions on the work are controlled.

3 Claims, 3 Drawing Sheets

ELONGATION CONTROL SYSTEM

BACKGROUND OF THE INVENTION

1. Field of the Invention

The present invention relates to control of the elongation of a work to be rolled in a rolling equipment applied to a steel process line.

2. Description of the Prior Art

In a rolling equipment, generally, for a high accuracy of thickness of a steel plate as the work, the elongation of the work is controlled. An example of such a control is disclosed in "TEKKO BENRAN (IRON AND STEEL HANDBOOK) III(I)", published by the Iron and Steel Institute of Japan in 1980, on pages 674 to 676, in which tension control and rolling load control are performed respectively by feedback control systems.

A conventional device of this type is shown in FIG. 1. In the figure, numeral 1 denotes a rolling mill for skinpass rolling of the work, numeral 2 a strip as the work, numeral 3 a bridle roll located on the entrance side of the mill 1, numeral 4 a motor for driving the entrance-side bridle roll 3 to rotate, numeral 5 a pulse oscillator fitted to the entrance-side bridle roll, numeral 6 a motor for driving the work roll of the rolling mill 1 to rotate, numeral 7 a bridle roll located on the exit side of the rolling mill 1, numeral 8 a motor for driving the exit-side bridle roll 7 to rotate, and numeral 9 a pulse oscillator fitted to the exit-side bridle roll 7. Numeral 10 denotes a screw down device for exerting a load on the strip 2, numeral 11 a tensiometer for detecting the tension on the strip 2 between the entrance-side bridle roll 3 and the rolling mill 1, and numeral 12 denotes a tensiometer for detecting the tension on the strip 2 between the rolling mill 1 and the exit-side bridle roll 7. Numerals 13, 14 and 15 denote feed rate controllers for controlling the rotational speeds of the motors 4, 6 and 8, respectively, numeral 16 a tension controller by which the difference between a reference tension $t_{1REF}$ and the actual tension measured by the tensiometer 11 is given to the speed controller 14 as a speed signal to thereby control the tension between the entrance-side bridle roll 3 and the rolling mill 1 to be constant, numeral 17 a tension controller by which the difference between a reference tension $t_{2REF}$ and the actual tension measured by the tensiometer 12 is given to the speed controller 15 as a speed signal to thereby control the tension between the exit-side bridle roll 7 and the rolling mill 1 to be constant, and numeral 18 denotes a tension compensating device which receives a signal indicative of the difference between the actual tension measured by the tensiometer 11 and the reference tension $t_{1REF}$ and outputs a signal for correcting the tension between the exit-side bridle roll 7 and the rolling mill 1. Further, numeral 19 denotes a elongation detector for detecting the speed difference between the entrance-side bridle roll 3 and the exit-side bridle roll 7 to measure the elongation of the work, and numeral 20 denotes a elongation control unit which receives a signal indicative of the difference between the elongation detected by the elongation detector 19 and a reference elongation $E_{ref}$ and outputs to the screw down device 10 a rolling load regulating signal for reducing the difference signal to zero.

Operations of the device will now be explained. First, the strip 2 is fed from the entrance side to the exit side of the rolling mill 1 as indicated by an arrow, while the elongation is measured based on the signals from the pulse oscillators 5 and 9 and the rolling load is regulated so that the measured elongation accords with the reference elongation $E_{ref}$. Next, when the measured elongation is varied due to some disturbance, the ratio of the number of pulses outputted by the pulse oscillator 5 in accordance with the rotational speed of the entrance-side bridle roll 3 to the number of pulses outputted by the pulse oscillator 9 in accordance with the rotational speed of the exit-side bridle roll 7 is varied, and a difference is generated between the elongation detected by the elongation detector 19 and the reference elongation. The difference signal is inputted to the elongation control unit 20, which outputs to the screw down device 10 a rolling load correction signal for reducing the elongation difference to zero, and the screw down device 10 applies a rolling load based on the correction signal to the strip 2. Besides, in order that the tension on the strip 2 between the entrance-side bridle roll 3 and the rolling mill 1 and the tension on the strip between the mill 1 and the exit-side bridle roll 7 are constantly fixed, the tension controllers 16 and 17 output speed correction signals to the speed controllers 14 and 15, thereby maintaining both of the tensions at the respective reference values.

Thus, the elongation of the work is controlled by regulating the rolling load exerted on the strip 2 by the rolling mill 1 while maintaining respectively fixed tensions on the strip 2 on the entrance side and exit side of the rolling mill 1.

In the above-mentioned conventional tension control system, however, the minor loop for correcting the rolling load and the minor loop for correcting the tension are independent of each other and, therefore, a variation in the rolling load is followed by a variation in the tension, which has a disturbing effect on the tension control system, resulting in poor response property of the elongation control.

SUMMARY OF THE INVENTION

An object of the present invention is to provide a control system capable of controlling the elongation of the work in a rolling process with enhanced response property and enhanced accuracy.

In a preferred embodiment, the elongation control system according to the present invention comprises a circuit for holding the rolling load as it is when the measured actual elongation accords with a preset elongation, and the system operates so that a signal indicative of the difference between a target screw-down position based on the rolling load held in the holding circuit and the measured actual press down position is supplied to a rate controller which controls the feed rate of the work on the exit side or the entrance side of the rolling mill.

Namely, the rolling load exerted on the work by the rolling mill is measured, and the rolling load as it is when the elongation of the work accords with a target elongation is held by a holding circuit. Thereafter, the variation in the rolling load is detected with the value held in the holding circuit as a reference, and this detected value is controlled by feed forward control system to the rate controller on the exit side or the entrance side so as to remove the variation of the tension on the work arising from the variation of the rolling load.

Accordingly, since the variation in the rolling load is derived from the elongation of the work and the feed rate of the work is corrected in accordance with the variation of the rolling load, it is possible to prevent the tension on the work from varying due to variations in the rolling load, so that response property of the elongation control can be enhanced, and the desired elongation can be obtained with high accuracy.

DESCRIPTION OF THE PREFERRED EMBODIMENT

Figure 1:
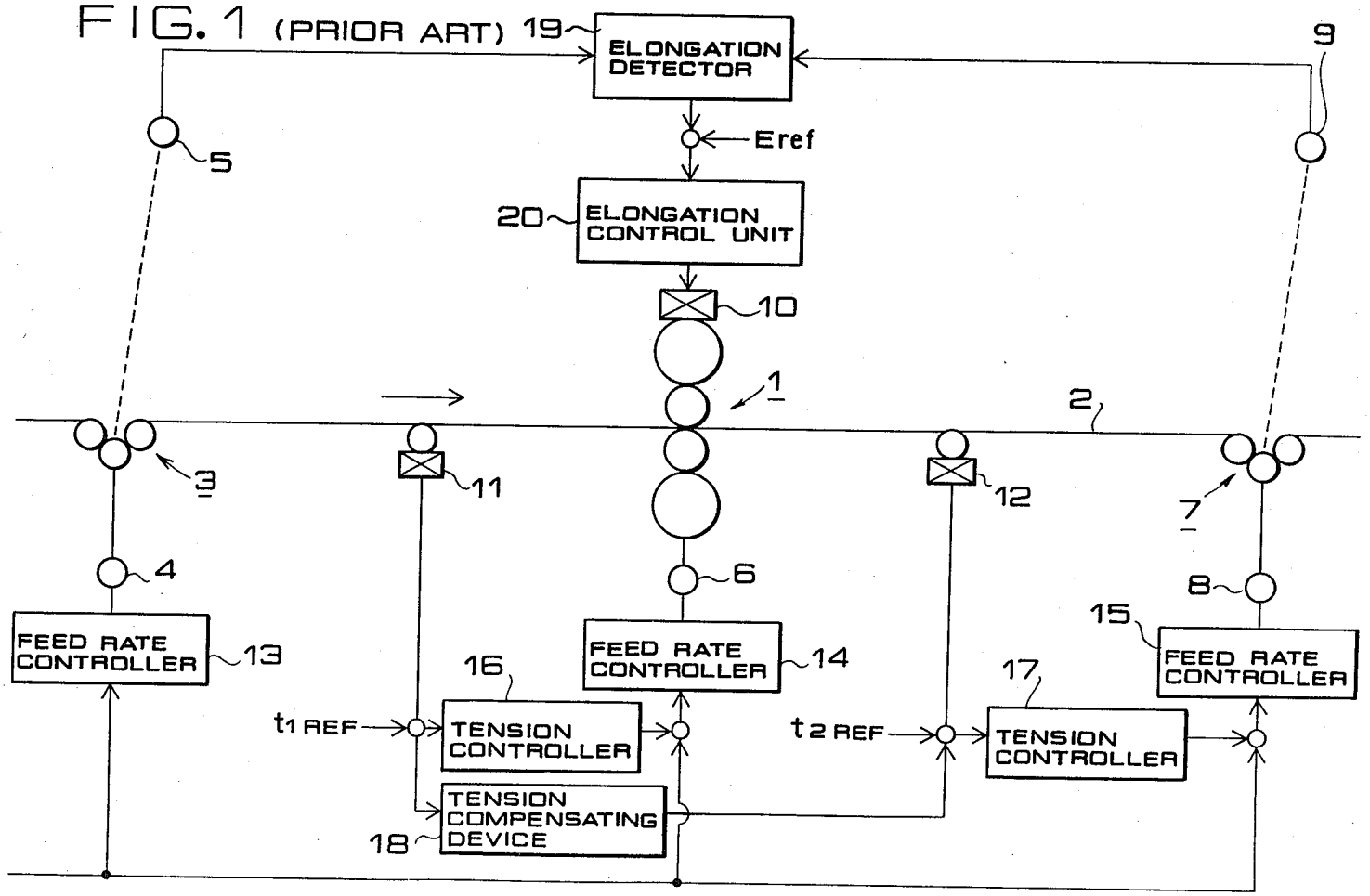
FIG. 1 (PRIOR ART)
FIG. 1 shows a block diagram of the conventional elongation control device for the work in a rolling equipment.
Figure 2:
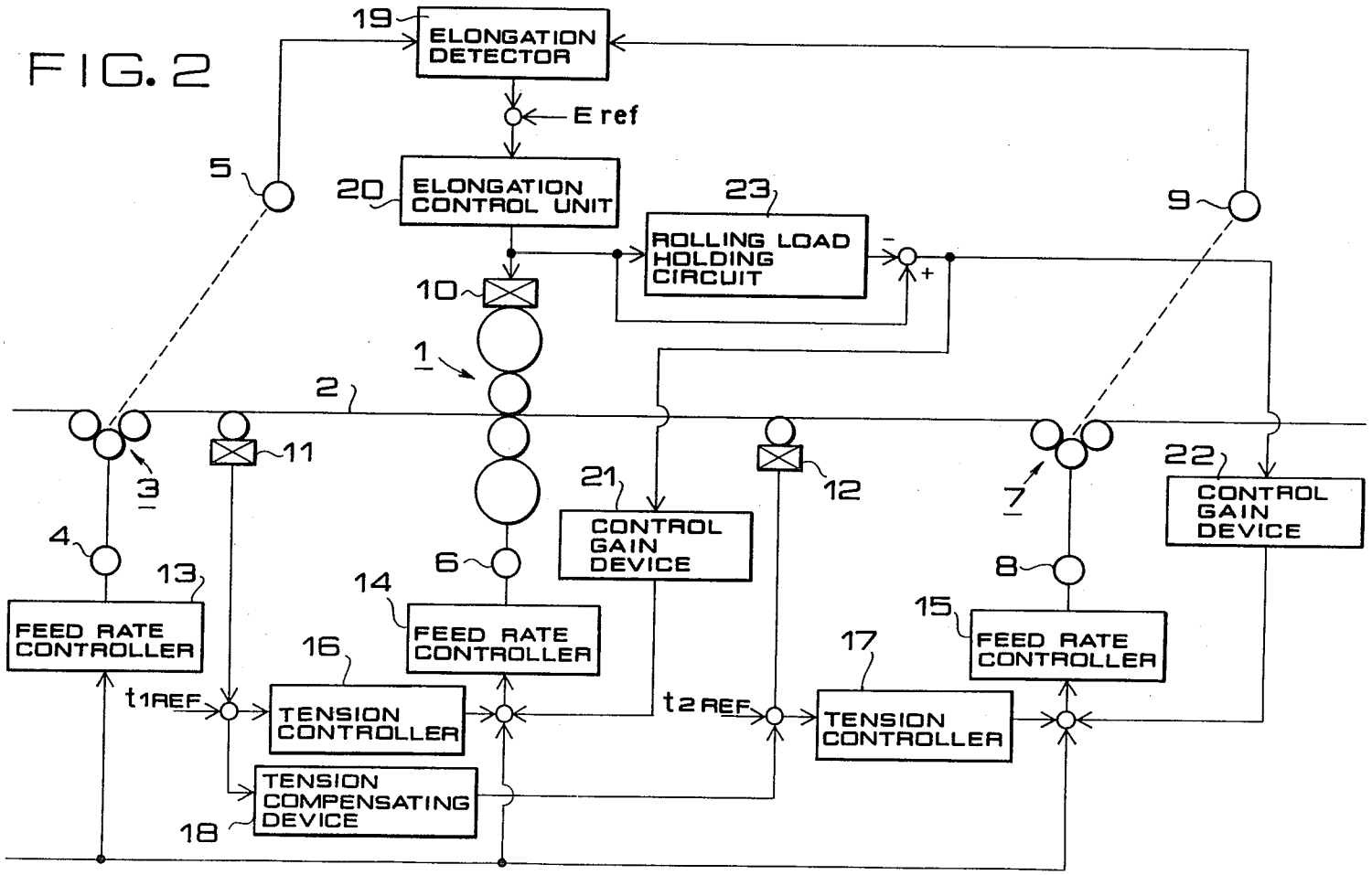
FIG. 2 shows a block diagram of the elongation control system according to one embodiment of the present invention.

One embodiment of the present invention will now be explained below while referring to the drawings. In FIG. 2, numerals 1 to 20 denote the same or corresponding parts to those in the conventional device shown in FIG. 1, and explanation thereof is omitted here. Numerals 21 and 22 denote control gain devices which multiply the signal indicative of the difference between a target screw-down position outputted from a rolling load holding circuit 23 and the actual screw-down position by predetermined control gains to obtain rate correction signals, and output the correction signals to feed rate controllers 14 and 15, respectively. Numeral 23 denotes a rolling load holding circuit which holds the rolling load at the time when the elongation detected by the elongation detector 19 accords with a reference elongation.

Figure 3:
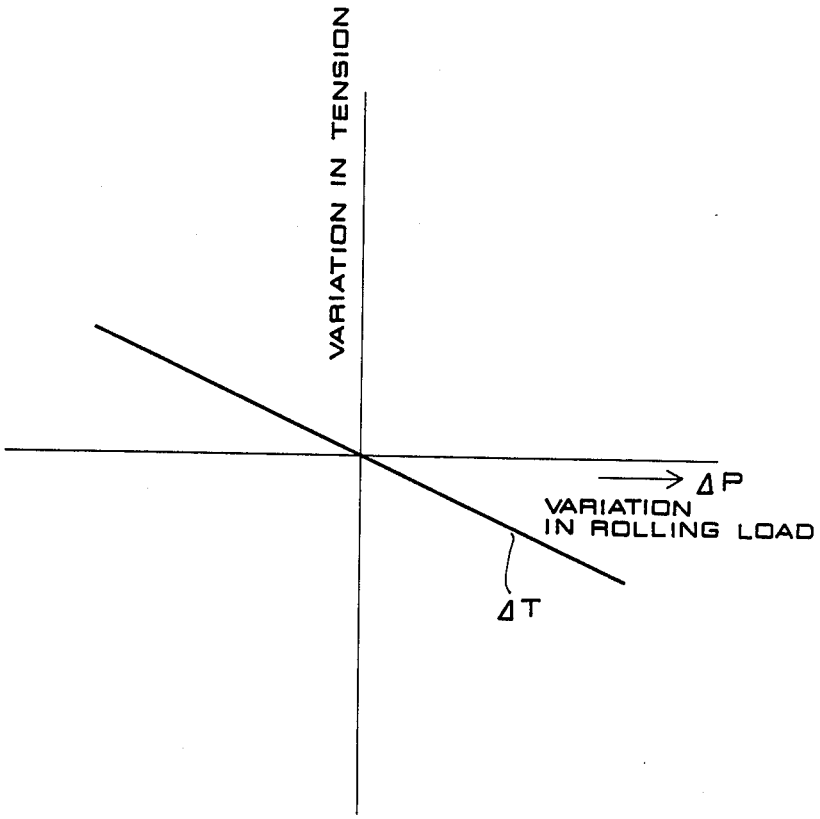
FIG. 3 shows a graph representing the relationship between the rolling load and the tension at a fixed elongation of the work being treated in a rolling process.

Operations of the system will now be explained. FIG. 3 shows the variations in tension, $\Delta T$, versus variations in rolling load, $\Delta P$, at a fixed elongation of the strip 2 as the work. It is seen from the FIG. 3 that a variation of rolling load causes a variation in the tension. Taking notice of this, according to the present invention the following operations are performed in order to prevent variations in the tension due to variations of the rolling load.

The rolling load at the time when the actual elongation detected by the elongation detector 19 accords with the reference elongation $E_{ref}$ is held by the rolling load holding circuit 23. When the elongation is varied, the elongation controller 20 outputs the variation as a rolling load regulating signal, resulting in a difference between the value held in the circuit 23 and the actual rolling load. A difference signal indicative of the difference is outputted to the control gain devices 21 and 22 serving as a feed rate corrective controller, whereby the difference signal is multiplied by predetermined control gains to be rate correction signals. In order to compensate for the variation of the tension, the control gain devices 21 and 22 output the rate correction signals as feedforward control signals to the rate controllers 14 and 15 which control the motors 6 and 8 for feeding the work. The feedforward signals are processed by the rate controllers 14 and 15, and used for rate control on the motor 6 for the work roll and the motor 8 for the exit-side bridle roll. As a result, the tension of the work is prevented from varying, even under variations of the rolling load in the rolling mill, and accordingly, the accuracy of the elongation of the work is enhanced.

Although explanation has been made of the case of a steel skinpass line in the above embodiment, the same effect as in the above embodiment can also be obtained when the present invention is applied to other steel processing lines in which the work undergoes elongation by rolling.

What is claimed is:

1. A system for controlling the elongation of a work to be rolled by a rolling mill through control of the rolling load in said rolling mill and control of tension on said work, comprising:

an elongation detector for measuring the actual elongation of said work being rolled by said rolling mill, an elongation control unit for controlling a press-down device of said rolling mill in accordance with the difference between said actual elongation measured by said elongation detector and a preset reference elongation, a device for holding the rolling load of said press-down device as it is when the elongation detected by said elongation detector accords with said reference elongation, a plurality of feed rate controllers, provided respectively on the exit side and on the entrance side of said rolling mill, for controlling the rates of feed of said work by work feeders based on tensions detected by tension detectors which detect the tension on said work on the exit side of said rolling mill and the tension on said work on the entrance side of said rolling mill, respectively, and a feed rate corrective controller for correcting the feed rate control of said feed rate controllers, according to the difference between the press-down position of said press-down device corresponding to the rolling load held in said rolling load holding device and a target press-down position.

2. A system according to claim 1, wherein said feed rate corrective controller comprises control gain devices which output rate correction signals to said feed rate controllers as feedforward signals to control the work feed rates, said rate correction signals being obtained by multiplying a signal indicative of the difference between the press-down position of said press-down device and said target press-down position by predetermined control gains.

3. A system according to claim 1, wherein said elongation control unit compares with the reference elongation an output of said elongation detector which detects an actual elongation of the work to be rolled in response to pulses of drive currents of said work feeders on the entrance and exit sides of said rolling mill in order to calculate a deviation in elongation and controls the rates of feed of the work by said work feeders in accordance with a tension control amount determined from the calculated elongation deviation, and when there appears a deviation in elongation, said elongation control unit makes a correction of the press-down load of said rolling mill in response to the elongation deviation.

* * * * *